US006125916A

United States Patent [19]

Arvedi et al.

[11] Patent Number: 6,125,916

[45] **Date of Patent: *Oct. 3, 2000**

[54] APPARATUS FOR THE HIGH-SPEED CONTINUOUS CASTING OF GOOD QUALITY THIN STEEL SLABS

[75] Inventors: Giovanni Arvedi, Cremona; Luciano Manini, Azzanello; Andrea Bianchi, Piadena, all of Italy

[73] Assignee: Giovanni Arvedi, Cremona, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 09/293,760

[22] Filed: Apr. 16, 1999

Related U.S. Application Data

[63] Continuation of application No. PCT/IT97/00276, Nov. 12, 1997.

[30] Foreign Application Priority Data

Nov. 12, 1996 [IT] Italy ..... MI96A2336

[51] Int. Cl.[7] ..... B22D 11/00; B22D 11/10

[52] U.S. Cl. ..... 164/418; 164/416; 164/437

[58] Field of Search ..... 164/437, 418, 164/416, 268

[56] References Cited

FOREIGN PATENT DOCUMENTS

| | | |
|---|---|---|
| 2 005 784 | 4/1971 | France . |
| 1 558 376 | 3/1970 | Germany . |
| 41 42 447 A1 | 12/1992 | Germany . |
| 43 41 719 C1 | 4/1995 | Germany . |
| 44 36 990 C1 | 12/1995 | Germany . |
| 60-247451 | 12/1985 | Japan . |
| 62-040962 | 2/1987 | Japan . |

*Primary Examiner*—Kuang Y. Lin

*Attorney, Agent, or Firm*—Akin, Gump, Strauss, Hauer & Feld, L.L.P.

[57] ABSTRACT

Apparatus for the continuous casting of steel slabs, especially low thickness slabs at high speed, comprising a mold (1) fed by the submerged nozzle (2) and connected to an oscillator (3) driven by a hydraulic servocontrol, wherein the following geometrical relation is valid concerning both the mold and the submerged nozzle shapes and their mutual arrangement:

$$0.9 \leq (A1/S1)/(A2/S2) \leq 1.1$$

and preferably A1/S1=A2/S2, wherein, on the mold horizontal section at the meniscus level, A1 is the area enclosed between the submerged nozzle and larger sides of the mold, and A2 is the residual area less the nozzle area, between submerged nozzle and smaller sides, S1 and S2 being the total sums of the mold peripheral lengths corresponding to each of said areas. Furthermore, at least in the mold horizontal section at the meniscus level, the distance between submerged nozzle and copper plates forming the mold walls is kept constant.

9 Claims, 4 Drawing Sheets

2
R=∞
4
II
1
R=Ro
3c
3b
3
3a
5

APPARATUS FOR THE HIGH-SPEED CONTINUOUS CASTING OF GOOD QUALITY THIN STEEL SLABS

CROSS-REFERENCE TO RELATED APPLICATION

This application is a continuation of International Application PCT/IT97/00276, filed Nov. 12, 1997, the disclosure of which is incorporated herein by reference.

BACKGROUND OF THE INVENTION

The present invention relates to an improved apparatus for high-speed continuous casting of high quality thin steel slabs.

Conventionally, the continuous casting of the so-called "thin slabs" of steel, up to 80 mm thick, has been subject to quality problems, especially for casting at high speed, e.g. above 4.5 m/mm.

Such problems result in flaws in the slab surface, i.e., the shell, which is formed in the mould, as follows:

- longitudinal cracks due to the trapping of casting powders;
- longitudinal and transversal cracks due to a lack of lubricating and insulating film formed by "slag" (i.e., the product of casting powders being melted and resolidified);
- longitudinal cracks due to thermal stresses; and
- longitudinal cracks due to the copper cooling surfaces of the mould being discontinuous.

These problems typically affect special steels, but could be at least partially solved by reducing the casting speed. However, reducing casting speed would lower productivity and accordingly reduce plant efficiency. Another possible solution to the above problems could be to use an electromagnetic device, called "EMBR" (ElectroMagnetic Brake Ruler), capable of flattening the liquid steel waves rippling along the meniscus inside of the mould. However, an EMBR is very expensive and would only partially solve the aforementioned problems. Additionally, other problems arise from the geometrical and flow conditions occurring inside the mould, resulting in a reduction of the operating life of the casting nozzle (which is dipped in the liquid metal and is usually called a "submerged nozzle") and in a reduction of process efficiency.

From the above discussion it should be clear that the quality control problems can not be solved in a systematic and satisfying way by independently concentrating on any one of the mould, the submerged nozzle and the mould oscillating unit. The above three elements are so interconnected in the continuous casting process that to solve the above-mentioned quality problems, the three elements must be treated together. Thus, to find an effective solution it is important to concentrate on the mould, the submerged nozzle, and the mould oscillating unit as a single group.

SUMMARY OF THE INVENTION

It is an object of the present invention to provide a casting unit that overcomes the above-identified problems when continuously casting thin slabs at high speed.

The improved casting unit of the present invention generally has the characteristics recited in claim 1.

BRIEF DESCRIPTION OF THE SEVERAL VIEWS OF THE DRAWINGS

Additional advantages and characteristics of a casting unit according to the present invention will be evident from the following detailed description of the preferred embodiment when examined in combination with the attached drawings, wherein.

DETAILED DESCRIPTION OF THE INVENTION

Figure 1:
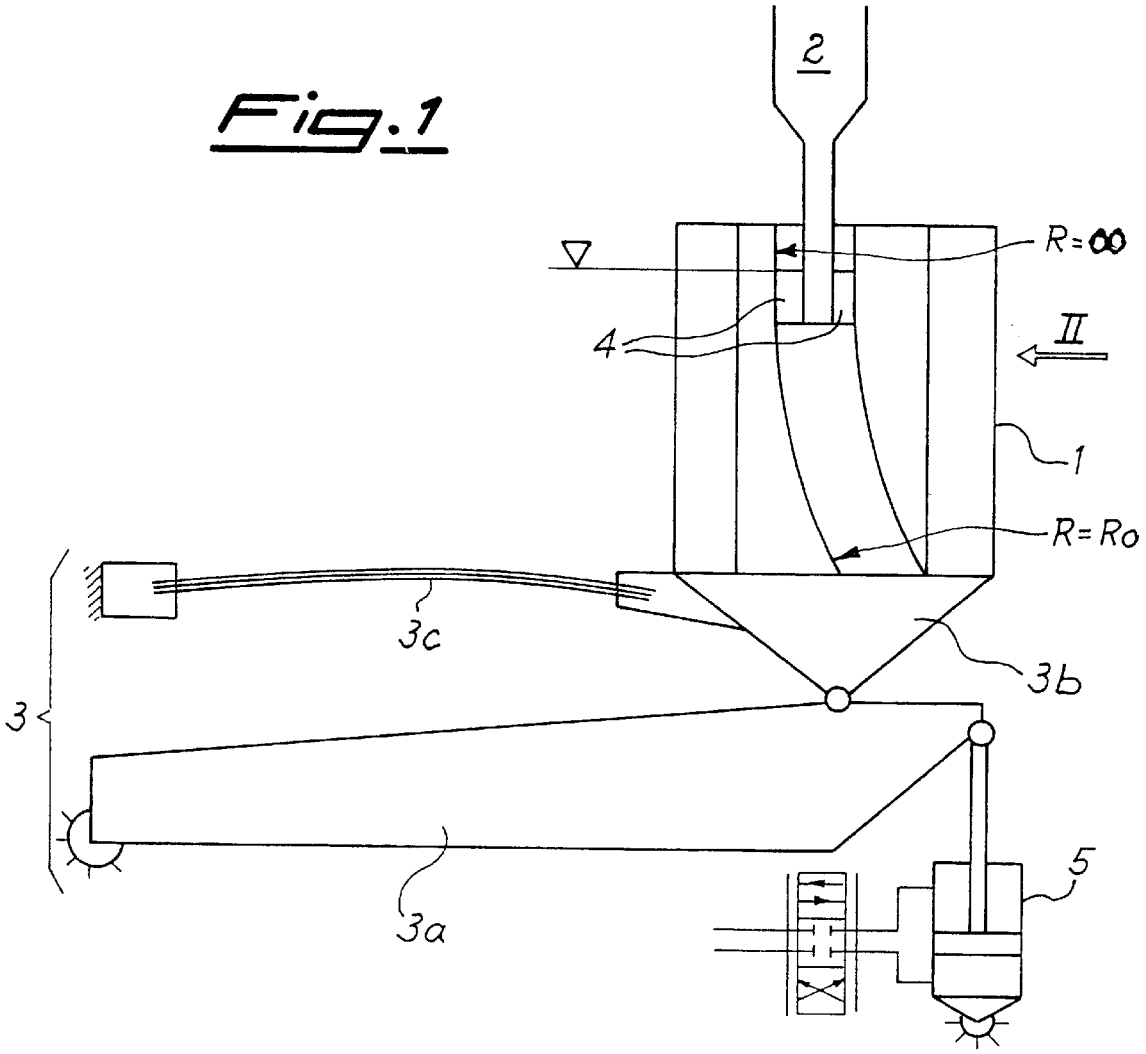
FIG. 1 shows a diagrammatic side view of a casting unit according to the invention illustrating the various components of the casting unit.

With reference to the drawings, FIG. 1 is a diagrammatic view of the casting unit according to the present invention which preferably includes a mould 1, a dip casting nozzle 2 (hereinafter always referred to as "submerged nozzle") and an oscillator 3 (which is hydraulically driven and is fastened to the mould body so as not to interfere with the casting line). FIG. 1 shows the area occupied by the liquid steel between the submerged nozzle 2 and the surrounding copper walls (i.e. the two "channels" 4).

Many of the problems that occur when casting thin slabs (as opposed to traditional thicker slabs) result from the fact that (assuming that the volumetric flow rate of molten steel is constant) a reduction in slab thickness increases the amount of slab surface contacting the mould walls within a given amount of time and thus, an increased amount of lubricating "slag" is necessary.

Thus, the importance of forming the proper amount of lubricating slag increases when the thickness of the slabs is reduced because the slab contact surface is inversely proportional with the thickness of the slab. Thus, the thinner the slab is the greater the amount of contact between the liquid steel in the mould and the mould walls per unit time. The increased amount of contact between the liquid steel in the mould and the mould walls results in an increased need for slag. However, the interface in the mould between the molten steel and the casting powders (i.e., the area over which slag is introduced) is reduced along the middle portion of the top surface of the liquid steel where the slag is formed, due to the reduced thickness of the mould and area occupied by the submersed nozzle.

Although this problem may be partially solved by using specific casting powders which are capable of enhancing slag formation, conventionally configured submerged nozzles and mould walls are not able to maintain the required equilibrium between the molten slag formed by melting casting powders and the slag consumed by the slab forming process.

The thin mould of the present invention is capable of containing a reliable, i.e. sufficiently thick, submerged nozzle, and the mould preferably has its large walls formed with copper plates. The walls have a profile that (when viewed in the horizontal plane, around the meniscus level) exactly matches the profile of the submerged nozzle and thus, keeps a constant normal distance between the submerged nozzle and the walls. The relative geometry of the mould and the casting nozzle are a part of the present invention. To quantify the various geometries the following terms are used: A1, A2, S1 and S2. Referring to FIG. 3*b*, the area A1 is the area between the casting nozzle and the mould walls directly above and below (as viewed in FIG. 36) the casting nozzle. The length S1 is the distance along the perimeter of the mould adjacent to area A1.

Figure 3A:
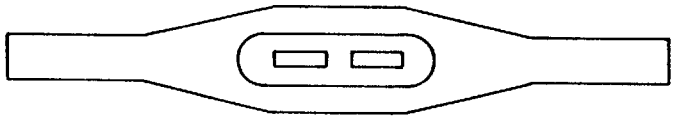
FIGS. 3*a*–3*c* show the same diagrammatic view, in a cross-section, taken along line III—III of FIG. 2, at the meniscus, or top surface of the liquid steel level, in order to particularly show the geometrical relation that the mould and the submerged nozzle must satisfy to form a casting unit according to the present invention.
Figure 3B:
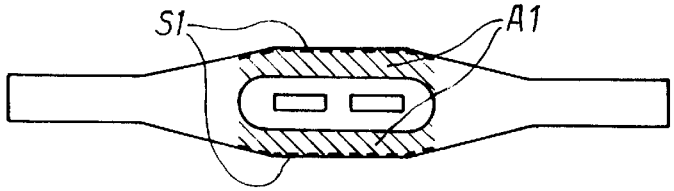
Figure 3C:
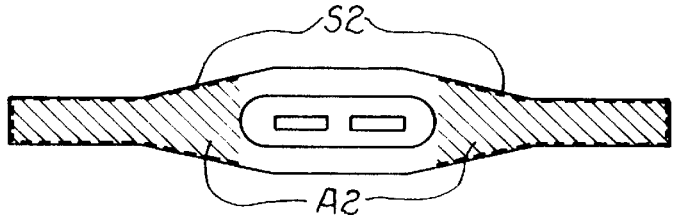

Referring to FIG. 3*c*, the area A2 is generally equal to the total area of the mould (as viewed in FIG. 3*c*) subtracting area A1 and subtracting the area of the casting nozzle (as viewed in FIG. 3*c*). The length S2 is equal to the length of the perimeter of the mould subtracting S1.

Figure 2:
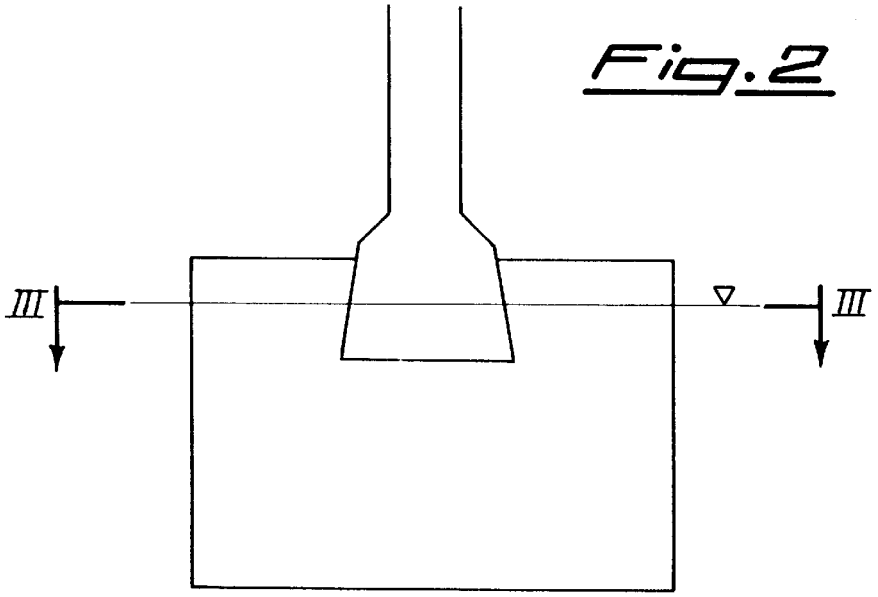
FIG. 2 shows a view of only the sole upper part of the mould, combined with the submerged nozzle, in the direction of arrow II of FIG. 1.

With reference to FIGS. 3*a*, 3*b* and 3*c*, a normal distance is chosen so that the ratio A1/S1 (see FIG. 2) is similar to the ratio A2/S2. The Present invention requires that A1/S1 is approximately the same as A2/S2, measured outside the submerged nozzle region (see FIG. 3*c*). Thus the equation to be satisfied is.

$$0.9 \leqq (A1/S1)/(A2/S2) \leqq 1.1, \text{ and preferably}=1$$

For example, for a mould being 1300×65 mm and having a submerged nozzle 300 mm wide (with a reliable thickness of 60 mm as indicated in FIGS. 3*b* and 3*c*), the optimal ratio A1/S1=A2/S2 is equal to 30. Such a ratio (once the dimensions of the submerged nozzle and the thickness of the smaller sides have been fixed) may be used for determining the desired mould profile in the horizontal plane at the meniscus level of the liquid steel in the mould. Alternatively, if the dimensions of the mould profile are known, the ratio may be used for determining the required profile of the submerged nozzle.

This geometrical configuration is also important for the flow of molten steel in the meniscus region, since the "channels" 4 which are located between the submerged nozzle and the copper mould walls will be sufficiently large to prevent vortex formation due to the acceleration of the streams converging in the middle from the mould's smaller sides. Vortex formation often causes the casting powders to be trapped, resulting in the improper generation of slag which results in the above-mentioned defects.

Preferably, the mould used in the casting unit of the present invention has a bend in the longitudinal direction, as detailed in European patent 0705152 (which disclosed a mould having a nearly infinite bending radius in the upper region for a better arrangement of the submerged nozzle), while providing for the bending of the slab being formed inside the mould with an exit on the arc-shaped casting guide other than the vertical. This advantageously reduces the height of the casting unit and accordingly the ferrostatic forces and the risk of slab swellings. According to the aforementioned patent application, the bending is graded in a progressive and uniform way from the infinite radius of the mould inlet to the bending radius $R_o$ corresponding to the casting guide (FIG. 1), thereby preventing both exceeding stresses on the solidified external shell of the slab and the possibility of an imperfect contact with the copper walls of the mould.

In order to adequately solve the above problems, the unit for cooling the mould plates is especially important and has to be capable of withstanding the high heat fluxes typically occurring in the formation of thin slabs (up to 3 $MW/m^2$, average value on the entire cooling surface of the mould). At the same time, cooling is preferably enhanced in the meniscus region in order to prevent copper cracks and to prevent thermal stresses from forming in the slab.

Figure 4:
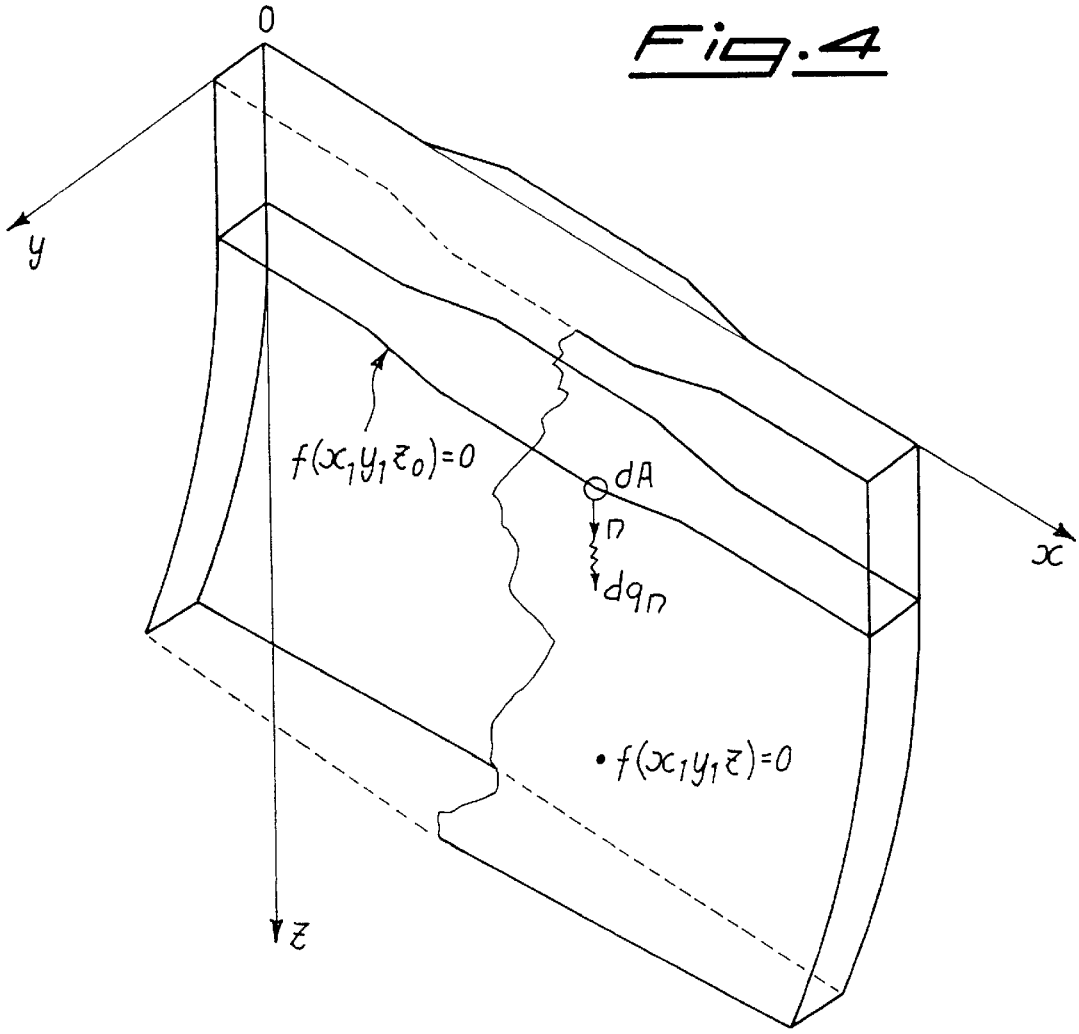
FIG. 4 shows a perspective view of the mould, diagrammatically represented with respect to a set of Cartesian axes.

With reference to FIG. 4, when considering the specific normal heat flux ($dq_n$) between the surface of the casting product and the mould, the following equation can be used:

$$dq_n = dq/dA[W/m^2]$$

This heat flux is partially a function of the local surface temperature on the hot surface of the copper plates, which is dependent upon the distance from the pipes wherein the cooling water flows.

Referring to FIG. 4, (a system of Cartesian axes x, y, z is superimposed on the mould, wherein the z axis extends toward the mould bottom and the complex surface formed by the mould is defined as f(x,y,z)=0) the local surface temperature varies according to the equation t=t[f(x,y,z)].

The heat flux $dq_n$ must be kept as constant as possible along a horizontal line (wherein $z=z_o$) belonging to the mould surface (i.e. the temperature t must be kept virtually constant along such a line) whereby:

$$t=t[f(x,y,z_o)]=t_o$$

Figure 5A:
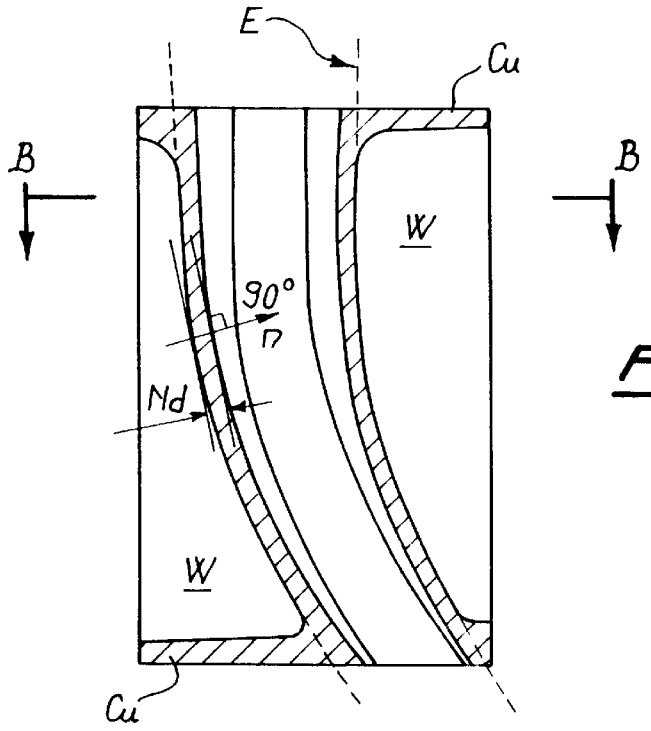
FIGS. 5*a* and 5*b* show two diagrammatic views of the mould of FIG. 4, wherein the ideal envelope of the cooling system pipes is represented in longitudinal section through a plane parallel to the y and z axes of FIG. 4, and along line B—B of FIG. 5*a*, respectively.
Figure 5B:
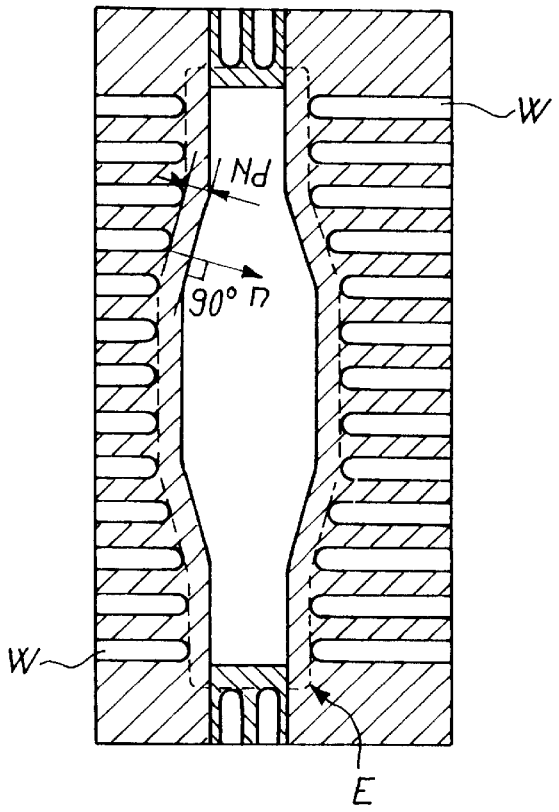

The above equation is obtained by keeping every point of the copper hot surface at generally the same normal distance Nd (which is measured along the perpendicular with respect to the hot surface) from the ideal surface envelope E of all the ends of the cooling pipes W (FIGS. 5*a*, 5*b*). Thus, Nd is constant, and experimentally it has been found that this constant value optimally ranges from 10 to 25 mm in order to have the aforementioned conditions for the cooling system.

As for the submerged nozzle, besides the aforementioned dimensional conditions with respect to the mould, it is preferably designed to allow the optimal behavior of the molten steel flow, while taking into account gradual shell formation and the life of the submerged nozzle. In fact, it is known that, upon decreasing of the slab thickness, the problems concerning the motions of the liquid inside the mould increase, resulting in the formation of stationary waves in the meniscus region and thus a local reduction of the thickness of the liquid slag, which adversely affects the lubrication and the insulation of the shell of the slab being solidified.

The submerged nozzle for thin slabs, which is detailed in patent application PCT/IT-97/00135, has geometrical characteristics which result in castings having a low energy, a high probability of energy dissipation inside the liquid volume of the slab, improved flow (thereby preventing vortex formation and powder trapping), and an improved liquid metal level control in the mould. Furthermore the feed is steady, the flow is substantially split into two streams and the surfaces inside the submerged nozzle are preserved to keep the same shape as at the beginning of the continuous casting. Since oxide deposits are negligible, these good flow conditions result in a reduced amount of external mechanical erosion of the nozzle in the meniscus region.

According to the present invention, the optimized design of the apparatus includes the ratio between the amplitude of the stationary wave (measured in mm) and the casting speed in m/min never exceeding 5, with an average value of 3.3.

Furthermore, the standard deviation measured for the sampled signal of the cast level in the mould (ML), indicated as stdDEV(ML), is usually within the following range:

$$\text{stdDEV(ML)}=0.7-1.5 \text{ mm}$$

Finally, the oscillator 3 is a critical factor for the surface quality of the slab and the reliability of the continuous casting process. With reference to FIG. 1, the oscillator 3 may be formed of a framework 3*a* being hinged to the floor and driven by a hydraulic servocontrol 5. Framework 3*a* is also hinged to a mould support 3*b*, thus forming a kind of quadrilateral together with a set of 3*c* fitted into both ends.

The control of the oscillator is managed by a program logic controller allowing the oscillator to change the oscillation parameters of the wave shape (e.g. the wave amplitude) between ±2 and ±10 mm. The controller continuously records the actual value of the casting speed so as to control the oscillation frequency based on the above parameters. Maximum oscillation frequencies have been obtained as high as 480–520 strokes/mm, for the first natural frequency of the entire dynamic system of 16.7 Hz. The flexibility is such that the oscillation parameters may be adjusted to obtain an optimal lubrication and surface quality depending on the casting speed.

Alternatively, the oscillator may be of the so-called "resonance" type with the mould being directly mounted upon flexure springs (without any lever system) and oscillated by a hydraulic servocontrol at a frequency close to the natural frequency of the elastic system.

Possible additions and/or modifications may be made by those skilled in the art to the above described and illustrated embodiment without departing from the scope of the invention. In particular, the mould itself may have in the vertical plane a profile other than the one disclosed in European patent 0705152 and the submerged nozzle may be different than the one disclosed and claimed in application PCT/IT-97/00135, provided that the aforementioned geometrical relations are complied with.

What is claimed is:

1. An apparatus for continuously casting steel slabs, comprising:

a mould having two longitudinal sides comprising copper for holding liquid steel, the mould being adapted to hold a predetermined amount of liquid steel to form a top surface at a predetermined position in the mould;

a plurality of cooling pipes each having an end disposed proximate to the mould, the ends of the cooling pipes collectively defining an ideal envelope surface;

a feeding nozzle having an outlet end adapted to be submerged in the liquid steel in the mould;

wherein the geometry of the nozzle and the mould as measured along a cross section taken along the top surface at the predetermined position satisfies the equation:

$$0.9 \leqq ((A1/S1)/(A2/S2)) \leqq 1.1$$

wherein:

A1 is the area between the outlet end and the longitudinal sides bounded by two lines extending generally perpendicularly between the longitudinal sides of the mould and each intersecting one of two lateral ends of the outlet end;

S1 is twice the length of one longitudinal side of the mould as measured between the two lines;

A2 is the area enclosed by the mold not including A1 and not including the area of the outlet end;

S2 is the entire perimeter of the mould less S1; and wherein a normal distance measured between the ideal envelope surface and a corresponding mould wall is generally constant.

2. The apparatus of claim 1, wherein the geometry of the nozzle and the mould as measured along the top surface at the predetermined position satisfy the equation:

$$0.95 \leqq ((A1/S1)/(A2/S2)) \leqq 1.05.$$

3. The apparatus of claim 1, wherein the geometry of the nozzle and the mould as measured along the top surface at the predetermined position satisfy the equation:

$$((A1/S1)/(A2/S2))=1.$$

4. The apparatus of claim 1, wherein the normal distance is in the range of between about ten millimeters to about twenty-five millimeters.

5. The apparatus of claim 1, further comprising an oscillator attached to the mould for generating a stationary wave in the liquid metal, the stationary wave having an average amplitude of between about two millimeters and about ten millimeters.

6. The apparatus of claim 5, further comprising a ratio between the amplitude of the stationary wave as measured in millimeters and a casting speed of the apparatus as measured in meters per minute is less than or equal to about five.

7. The apparatus of claim 6, wherein the standard deviation of a height of an upper surface of the liquid metal in the mould is in the range of between about 0.7 millimeters and about 1.5 millimeters from the predetermined position.

8. The apparatus of claim 1, further comprising:

an oscillator attached to the mould for generating a stationary wave in the liquid metal; and a controller operatively engaged with the oscillator for varying an amplitude of the stationary wave in the range of between about two millimeters and about ten millimeters.

9. The apparatus of claim 8, wherein the oscillator includes a plurality of springs that are operated at a natural frequency of the oscillator.

* * * * *